US007124889B2

(12) United States Patent
Fuemmeler

(10) Patent No.: US 7,124,889 B2
(45) Date of Patent: Oct. 24, 2006

(54) ROLLED FILM AND PALLET CONSTRUCTION

(75) Inventor: Carl D. Fuemmeler, County of Boone, MO (US)

(73) Assignee: Mexico Plastic Company, Mexico, MO (US)

( * ) Notice: Subject to any disclaimer, the term of this patent is extended or adjusted under 35 U.S.C. 154(b) by 118 days.

(21) Appl. No.: 10/796,676

(22) Filed: Mar. 9, 2004

(65) Prior Publication Data

US 2004/0182731 A1 Sep. 23, 2004

Related U.S. Application Data

(60) Provisional application No. 60/455,255, filed on Mar. 17, 2003.

(51) Int. Cl.
*B65D 19/44* (2006.01)
*B65D 85/67* (2006.01)

(52) U.S. Cl. ..... 206/391; 108/53.5; 108/55.1; 108/57.17

(58) Field of Classification Search ..... 206/386, 206/391, 393–394, 392; 108/51.3, 53.5, 108/55.1, 57.17, 57.19, 57.21, 57.33, 51.11, 108/56.1, 56.3, 901
See application file for complete search history.

(56) References Cited

U.S. PATENT DOCUMENTS 2,326,928 A * 8/1943 Courson ..... 206/392
2,450,432 A 10/1948 Lehman
2,471,693 A * 5/1949 Jacob ..... 108/55.1
2,625,355 A 1/1953 Adams
2,873,935 A * 2/1959 De Pew et al. ..... 108/57.17
2,890,849 A 6/1959 Fogarty
3,135,227 A * 6/1964 Yerkey et al. ..... 108/56.3
3,227,272 A * 1/1966 Critzer ..... 206/392
3,294,041 A 12/1966 Lessheim
3,348,723 A * 10/1967 Wilson ..... 108/55.1
3,855,944 A * 12/1974 Skubic et al. ..... 108/55.1
3,878,796 A 4/1975 Morrison
3,954,067 A 5/1976 Miles
4,033,455 A * 7/1977 Robison ..... 206/391
4,059,057 A 11/1977 Carnwath
4,220,099 A 9/1980 Marchesano
4,240,358 A 12/1980 Munroe
4,424,752 A 1/1984 Aberg
4,597,338 A 7/1986 Kreeger
4,715,294 A 12/1987 Depew
4,841,880 A 6/1989 Ferguson
4,846,077 A 7/1989 Win
4,998,619 A * 3/1991 Sowa et al. ..... 206/392

(Continued)

*Primary Examiner*—Bryon P. Gehman
(74) *Attorney, Agent, or Firm*—Polster, Lieder, Woodruff & Lucchesi, L.C.

(57) ABSTRACT

A rolled film and pallet combination for storing rolls of film material wound on a core whose ends extend past the ends of the rolls, with the pallet being symmetrical and having aligned openings in the top and bottom to accommodate the core ends. The pallet comprises spaced pairs of longitudinal stringers which define the top and bottom of the pallet and spaced transverse ribs which are positioned between the pairs of longitudinal stringers to define the aligned openings in the top and bottom of the pallet into which the core ends are placed. The pallets are symmetrical so they can be rotated 90° in any direction and still be packed the same. The pallets can also be turned top for bottom. The rolls of film are packed in paperboard containers so that the core ends protrude through openings in the ends of the containers into the pallet openings.

7 Claims, 4 Drawing Sheets

U.S. PATENT DOCUMENTS 5,101,737 A 4/1992 Gomez
5,344,014 A * 9/1994 Toral et al. ..... 206/394
5,388,533 A 2/1995 Pigott
5,487,343 A 1/1996 Phillips
5,809,902 A 9/1998 Zetterberg
5,896,819 A 4/1999 Turila
5,967,056 A 10/1999 Plante
6,386,118 B1 5/2002 Bendit
6,389,989 B1 5/2002 Hagerty
6,418,862 B1 7/2002 Heil
6,446,563 B1 9/2002 Ohanesian

* cited by examiner

ROLLED FILM AND PALLET CONSTRUCTION

CROSS REFERENCE TO RELATED APPLICATIONS

This application is related to U.S. Provisional Patent Application 60/455,255 filed Mar. 17, 2003 from which priority is claimed.

BACKGROUND OF THE INVENTION

1. Field of the Invention

The present invention relates to pallets for storing and transporting rolls of thin plastic tubing wrapped around a circular core. More particularly, the invention relates to a symmetrical pallet having openings in the deck to accommodate the ends of the core of the roll of film so that the pallets can be stacked one atop another in a stable package.

2. Background Prior Art

U.S. Pat. No. 4,898,102 discloses a pallet assembly designed to support coils of sheet metal, sheet paper, or barrels and the like. The design is simple and relies upon a special notching that works to interconnect four pieces of square wood in a manner which provides a pallet structure without the use of nails.

U.S. Pat. No. 3,131,655 discloses a pallet designed to carry products that take the form of flat sheets, such as sheet steel and drywall material. A unique feature of the design is the use of three stringers wherein the center stringer has less vertical height than the outboard stringers. When loaded, the weight of the load on the pallet causes the center of the pallet to drop due to the less tall center stinger. The resulting bow in the material acts to tilt the load toward the center of the pallet and thus resists the tendency of the flat sheets to slide off the pallet during pallet transportation.

U.S. Pat. No. 2,570,757 discloses a pallet designed to store and transport bagged material. The pallet design includes a flat upper surface upon which two spacers are placed prior to the placement of bags upon the pallet. After the pallet is stacked with the bags, a compression device pushes downward on the bags to cause the bags to interlock and form around the spacers. The spacers act to keep the bags from sliding off of the pallet and are removed when a fork lift is used to lift the load of bags from the pallet by inserting the forks of the lift into the openings left after the spacers are removed.

The device in U.S. Pat. No. 3,237,786 is a pallet designed to store and transport piping material. The pallet has a flat upper surface which has two stop cleats on two opposite sides of the pallet. The two stop cleats act as barriers which contact the longitudinal surface of the piping to prevent the piping from rolling off the pallet. A strap is used to contain higher levels of piping on the pallet.

U.S. Pat. No. 4,230,051 discloses a pallet having a number of U-shaped retainers for holding loose material onto the upper surface of the pallet and to add strength to the pallet structure.

U.S. Pat. No. 4,184,435 shows a pallet design which consists of a number of pallet styles which can be constructed from waste material. Apparently, the purpose of the designs is to prevent the needless destruction of our national forests.

SUMMARY OF THE INVENTION

The present invention comprises a pallet base that can be made of wood and is designed to hold coils of thin wall flexible plastic pipe produced in rolled form, particularly pipe used as irrigation tubing used to flood-furrow irrigate crops.

These and other objects and advantages will become apparent hereinafter.

DESCRIPTION OF THE DRAWINGS

In the drawings wherein like numbers and letters refer to like parts wherever they occur.

DETAILED DESCRIPTION

The present invention involves a skid for rolled tubing. The tubing is thin-wall flexible plastic pipe produced in rolled form. A typical single roll has a 10 mil wall thickness, is 15 inches in diameter and is 1320 feet long. This product is extruded and wound on cores. A finished roll of tubing (before unwinding) is cylindrical in shape; about 19 inches in diameter and 24 inches tall.

I have designed a special pallet or skid that allows one to package, transport, and store the finished product in a manner that is superior to any methods now being used. Some of the special features and benefits of the skid are:

1. It allows the rolls of tubing to be stacked vertically on the skid which provides for a more stable package.

2. Because the rolls can be stacked vertically on the skid, they become "columns" which allows the nesting of one skid on top of another without the use of additional load distributing devices such as shelving, racking or plywood slip sheets between skids. I have successfully stacked the skids eight units high without any problems or damage. This ability to stack the skids greatly reduces required floor space for finished product for the manufacturer, the distributor and the user.

3. Each roll of tubing is wound on a cardboard core. In order for users to easily unwind the tubing when used, the cores protrude about 1½" beyond the edge of the roll on each side of the roll. The platform of the skids is designed in such a way that allows the core to clear the planks of the skid's platform. Therefore, when each roll is placed vertically on the skid the flat edge of the roll rests flat and level on the skid platform and the protruding cores slip though platform planks (due to plank spacing). Similarly, when a second skid is stacked on top of a first skid, the bottom platform planks of the top skid are designed in such a way that allows the protruding core to clear the platform planks and hence the bottom of the top platform comes to bear on the top surface of the rolls on the lower or first skid. The skids can continue to be stacked vertically in this manner.

4. Each skid is symmetrical in design so that it can be rotated 90 degrees in any direction and still be packed the same. The top and bottom of each skid is identical which allows for ease of use and proper nesting or stacking of the loaded skids one atop another.

5. Before placing the roll of tubing on the skid, each roll of tubing is packed in a corrugated cardboard carton for protection. The carton is designed in such a way to allow the cores to protrude through the carton and then protrude through the planks of the skid. This allows the flat edge of the roll to rest flat and level on the skid platform.

Figure 3:
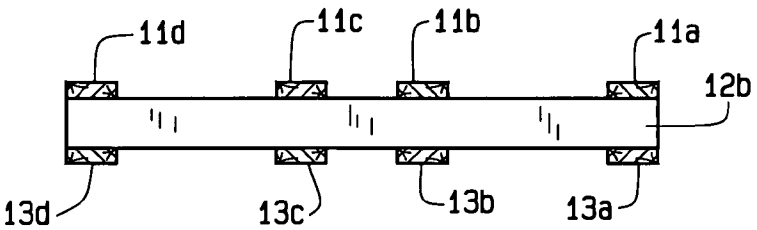
FIG. 3 is a sectional view taken along line 3—3 of FIG. 1.
Figure 1:
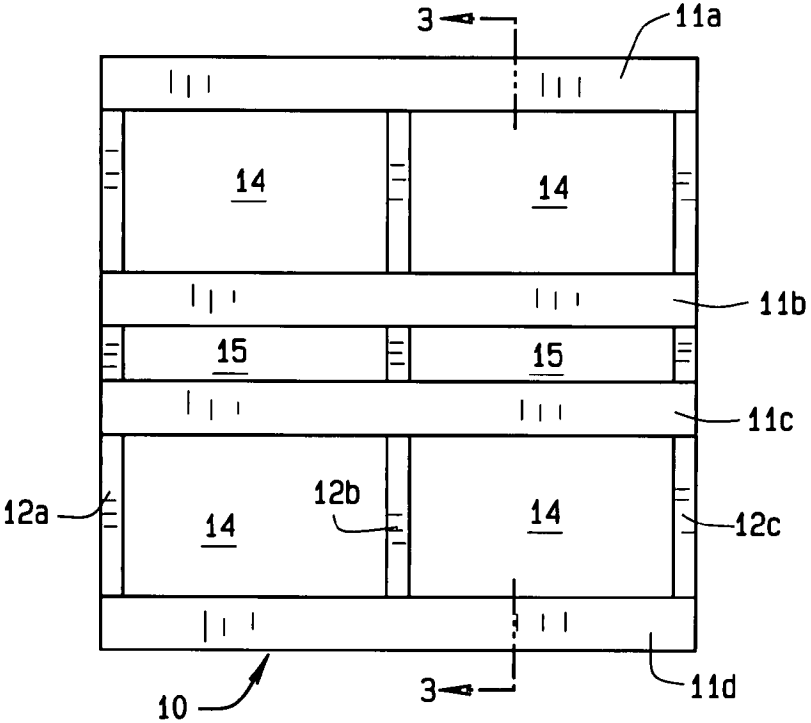
FIG. 1 is a top plan view of the skid of this invention.
Figure 2:
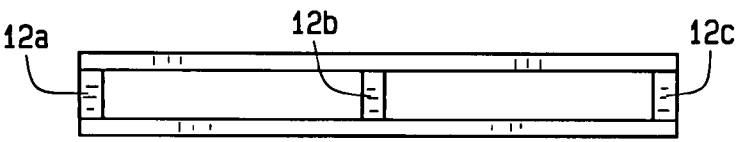
FIG. 2 is an end elevational view of the skid of FIG. 1.
Figure 5:
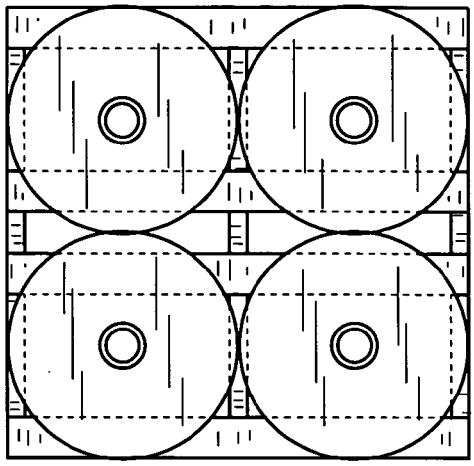
FIG. 5 is a detailed plan view of rolls of tubing on a skid.

The attached drawings show the pallet and rolled film in detail. FIGS. 1–3 show a pallet 10 which preferably is square and is symmetrical and the top and bottom are identical. This allows the pallet 10 to be rotated 90° in any direction and still be packed the same. The identical top and bottom allow the skid to be used in any orientation and provides proper nesting when loaded skids are stacked atop each other. The skid 10 has longitudinal top stringers or planks 11*a*–*d*, lateral spacer ribs 12*a*–*c* and longitudinal bottom stringers or planks 13*a*–*d* which are aligned with the top stringers 11*a*–*d*. The stringers 11*a*–*d* and 13*a*–*d* are fastened to the edges of the ribs 12*a*–*c*.

The ribs 12*a* and 12*c* are positioned at the ends of the stringers 11*a*–*d* and 13, and the rib 12*b* is positioned at their centers. The stingers 11*a*–*d* and the ribs 12*a*–*c* are all preferably about 40 inches in length. The ribs 12*a*–*c* are boards preferably 1½"×3½" and the stringer 11*a*–*d* and 13*a*–*d* preferably are boards 1"×3½". The stringers 11*a*–*d* and 13*a*–*d* are space ribs 12*a*–*c* such that there are two large rectangular openings 14 between the end stringer 11*a* and the nearest inner stringer 11*b* and between the end stringer 11*d* and the nearest inner stringer 11*c*. There are two thinner rectangular openings 15 between the innermost stringers 11*b* and 11*c*. Similar sized openings 14, 15 also are present between the bottom stringers 13*a*–*d*, making the pallet 10 symmetrical on all sides.

Figure 4:
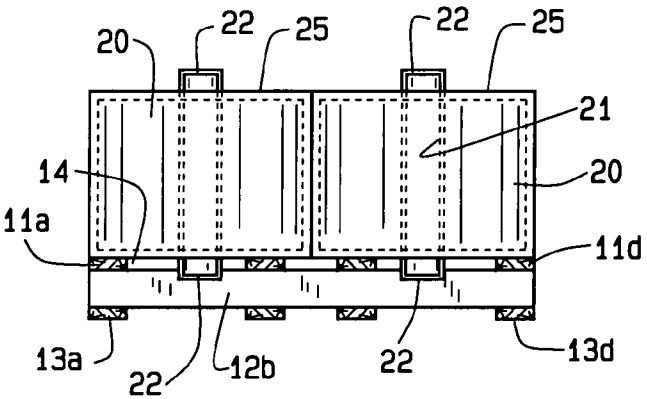
FIG. 4 is a detailed side elevational view partly in section of rolls of tubing in paperboard cartons loaded on a skid.

The pallet 10 is designed to hold four rolls 20 of extruded flat tubing. The rolls are shown in broken lines in FIG. 4. The tubing is thin-wall flexible plastic pipe which is extruded and produced in rolled form on a paperboard core 21. The tubing in a single roll is preferably 10 mil wall thickness and about 15 inches in diameter and 1320 feet long. The roll dimensions are about 19 inches in diameter and 24 inches tall. The core 21 has an extension 22 of about 1½ inches past the ends of the roll 20 on each side of the roll 20 to facilitate handling by the customer.

The core extensions 22 fit into the large openings 14 between the stringers 11*a*–*d* and 13*a*–*d* so that the roll 20 will set flat on the skids 10 and a second pallet 10 can be stacked flat on the top of the rolls 20.

Figure 9:
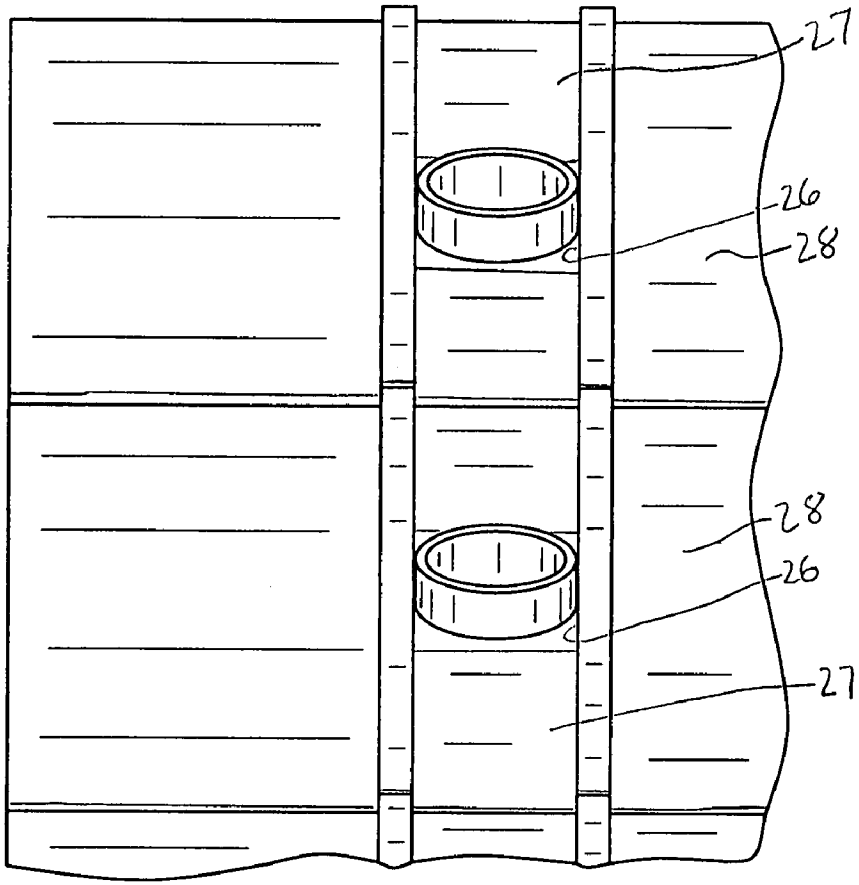
FIG. 9 is a perspective view of a series of stacked pallets with the rolls of tubing encased in packing cartons.
Figure 10:
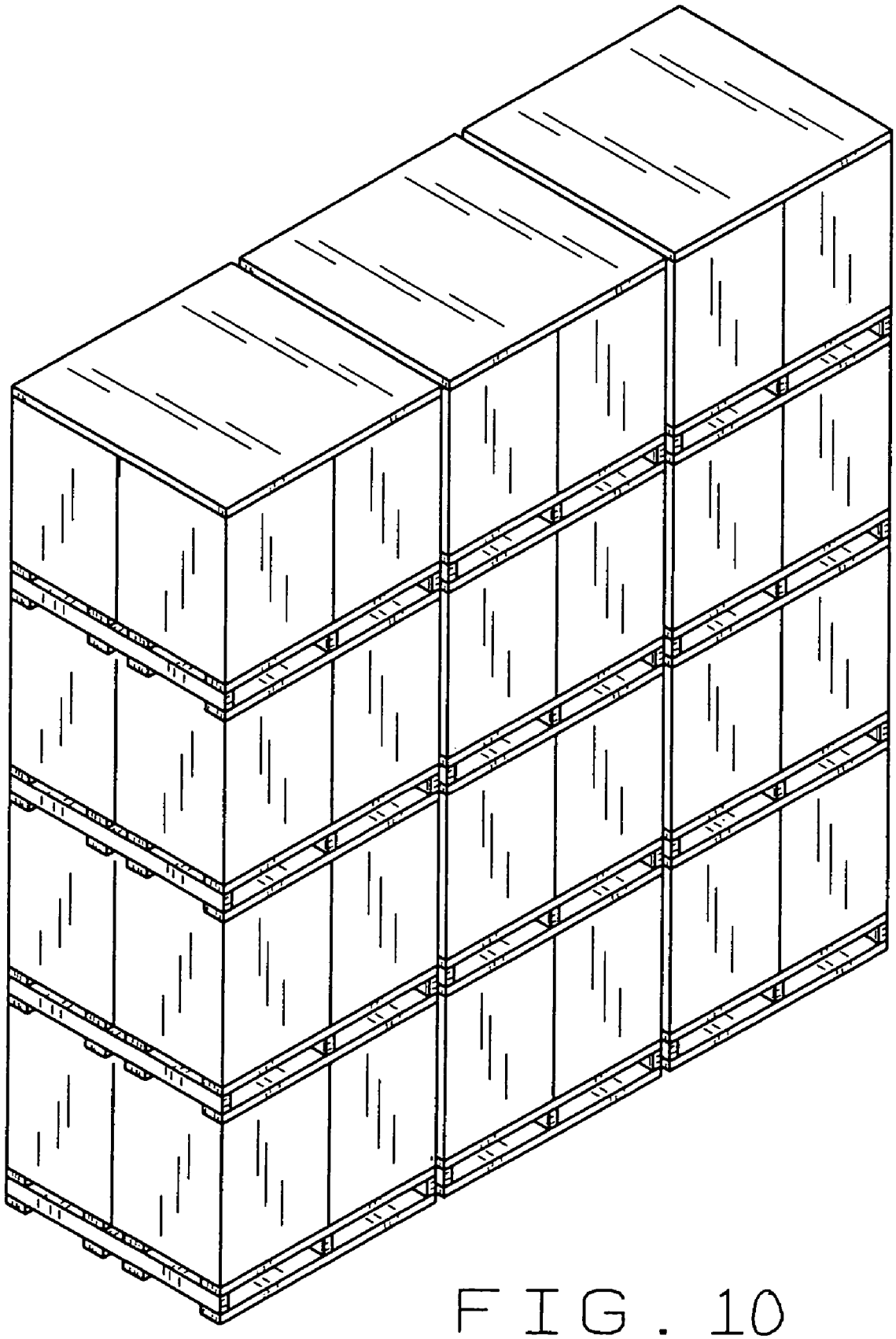
FIG. 10 is a perspective view of a stack of cartons on pallets.

The rollers 20 are packed in corrugated paperboard containers 25 (shown in broken lines in FIG. 4) which has openings 26 (FIG. 9) in the ends to allow the core extensions 22 to protrude and fit into the pallet openings 14. This allows the rolls 20 to reside flat and level on the skid 10 and allows stacking of loaded skids 10. The openings 26 are formed by the end flaps 27 and side flaps 28. The end flaps 27 do not meet and the side flaps 28 also do not meet which forms the rectangular opening 26. FIG. 10 shows a stack of cartons 25 on pallets.

Figure 7:
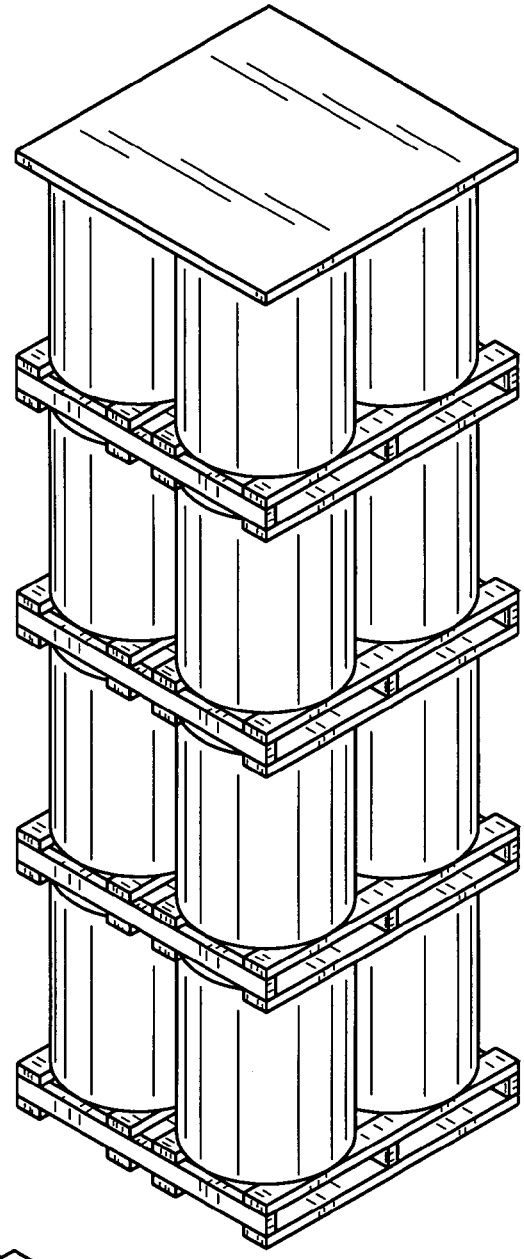
FIG. 7 is a perspective view of a stack of skids loaded with rolls of tubing not encased in paperboard.
Figure 6:
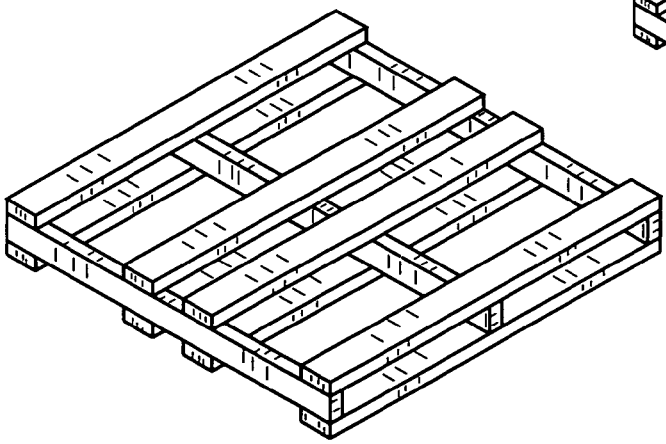
FIG. 6 is a perspective view of a skid.
Figure 8:
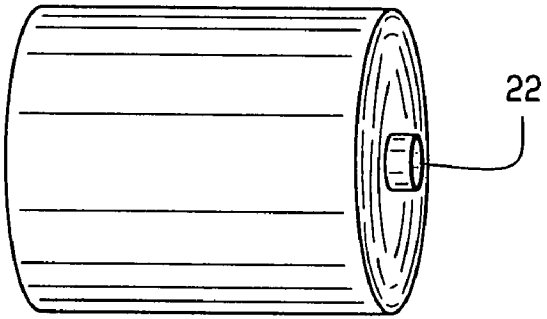
FIG. 8 is a perspective view of a roll of tubing.

FIGS. 6–8 show the skid 10 (FIG. 6); a stack of loaded pallets four skids high (FIG. 7); and a roll of film 20 showing the protruding core extension 22 (FIG. 8).

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

What is claimed is:

1. A rolled film and pallet combination comprising (a) a pallet comprising four longitudinal top stringers, three transverse ribs, and four longitudinal bottom stringers, two of the longitudinal top and two of the longitudinal bottom stringers being located opposite each other at the ends of the transverse ribs, the other of the two longitudinal top and the two longitudinal bottom stringers being located opposite each other on the ribs intermediate the ends of the ribs to define four sets of aligned top and bottom stringers with aligned top and bottom spaces between the end stringers and the intermediate stringers, and (b) four rolls of plastic film, each wound on a core with the ends of the cores extending beyond the ends of the rolls a distance less than one half the distance between the outer surfaces of each pair of the top and bottom stringers, the rolls being positioned on the top surface of the top stringers with the ends of the cores being located in the spaces between the end stringers and the adjacent intermediate stringers.

2. The combination of claim 1 including paperboard containers for each of said rolls, each paperboard container having flat sides and a flat top and a flat bottom, the tops and bottoms having apertures therein to accommodate the core ends of the rolls contained in the containers.

3. The combination of claim 2 wherein the tops and bottoms of the containers are defined by end flaps and side flaps which are folded inwardly and are sized to leave a gap at the centers of the tops and bottoms to accommodate said core ends.

4. The combination of claim 1 wherein the spaces between the end stringers and their adjacent intermediate stringer in the same plane are greater than the spaces between the said intermediate stringers in the same plane.

5. The combination of claim 1 wherein the top stringers, the transverse ribs and the bottom stringers all have substantially the same length whereby the pallet is symmetrical.

6. A plurality of the rolled film and pallet combinations of claim 1 stacked one atop another.

7. A plurality of the rolled film and pallet combinations and paperboard containers of claim 2 stacked one atop another.

* * * * *

UNITED STATES PATENT AND TRADEMARK OFFICE

CERTIFICATE OF CORRECTION

PATENT NO. : 7,124,889 B2
APPLICATION NO. : 10/796676
DATED : October 24, 2006
INVENTOR(S) : Carl D. Fuemmeler It is certified that error appears in the above-identified patent and that said Letters Patent is hereby corrected as shown below:

Col. 3, Line 32
Replace "space"
with -- spaced along the --

Signed and Sealed this

Nineteenth Day of June, 2007

JON W. DUDAS
*Director of the United States Patent and Trademark Office*